United States Patent [19]

Holden

[11] 4,000,551

[45] Jan. 4, 1977

[54] PRODUCTION OF BULKY YARNS

[75] Inventor: Gordon Alan Holden, Bargoed, Wales

[73] Assignee: Crimpfil Limited, Bargoed, Wales

[22] Filed: Jan. 15, 1975

[21] Appl. No.: 541,355

[52] U.S. Cl. ..... 28/72.12

[51] Int. Cl.[2] ..... D02G 1/16

[58] Field of Search ..... 28/1.4, 72.12, 34 B, 28/75 WR, 72 HR; 57/140 B, 157 F; 428/364

[56] References Cited

UNITED STATES PATENTS

| | | | |
|---|---|---|---|
| 2,962,794 | 12/1960 | Field | 28/72.12 |
| 2,979,883 | 4/1961 | Waltz | 28/72.12 X |
| 3,388,444 | 6/1968 | Benson | 28/72.12 |

*Primary Examiner*—Louis K. Rimrodt
*Attorney, Agent, or Firm*—Woodhams, Blanchard and Flynn

[57] ABSTRACT

A method of producing a bulky continuous filament yarn which includes the steps of feeding primary and secondary continuous multi-filament polymeric yarns into a treatment zone, with one of the yarns being pretreated by the application of water so that said one yarn is wet when fed into the treatment zone. The yarns in the treatment zone are subjected to a turbulent fluid flow which causes the individual filaments of the yarns to separate, and also causes ringlike loops to be formed at randomly spaced intervals along the individual filaments of the secondary yarn. The filaments of the yarns become intermingled within the treatment zone and are withdrawn and collected in the form of a single yarn. The primary yarn is fed into the treatment zone at a rate between 4% and 26% greater than the rate at which the intermingled filaments are withdrawn from the treatment zone, and the secondary yarn is fed into the treatment zone at a rate which is at least 2.5% greater than the rate of feed of the primary yarn and up to 30% greater than the rate at which the intermingled fibres are withdrawn from the treatment zone.

7 Claims, 6 Drawing Figures

LOW OVERFEED

INTERMEDIATE OVERFEED

HIGHEST OVERFEED

COMPOSITE YARN

PRODUCTION OF BULKY YARNS

BACKGROUND OF THE INVENTION

The invention relates to the production of bulky, continuous filament yarns.

United Kingdom Patent Specification No. 732,929 describes and claims a bulky, continuous filament yarn and a method and apparatus for its manufacture in which a multi-filament flat yarn is subjected to the action of a fluid stream in a zone of sufficient turbulence to separate the individual filaments and to form them into ring-like, crunodal loops and other convolutions. To accommodate the formation of these loops and other convolutions, the yarn is fed into the turbulent zone at a greater speed than it is withdrawn.

Whilst the resultant bulky yarn is suitable for the production of fabrics for some end uses, it does not have sufficient bulk for fabrics of some other end uses. For example: boucle type yarns suitable for the production of upholstery fabrics cannot be produced by subjecting a single end of yarn to turbulence. In practice, fabrics produced by subjecting a single yarn end to turbulence are subject to pluckiness and lack of stability.

It has therefore been proposed, in United Kingdom Patent Specification No. 893,020, to produce core and effect yarns in which a yarn providing the core filaments of the core and effect yarn are fed into a zone of fluid turbulence at a much lower speed than each of the filaments providing the loops and other convolutions necessary in highly bulked fancy yarn. However, although these core and effect yarns are suitable for the production of upholstery fabrics, they are not suitable for knitted or woven apparel fabrics.

SUMMARY OF THE INVENTION

It is therefore an object of the present invention to provide a continuous filament yarn having improved bulkiness, stability and covering power hitherto unattainable by known methods of production.

According to the invention, there is provided a method of producing a bulky, continuous filament yarn including the steps of feeding primary and secondary continuous multi-filament yarns comprising, respectively, at least 20% and up to 80% of the total filaments into a treatment zone; providing within the treatment zone a fluid flow of sufficient turbulence to separate the individual filaments of the yarns, to form crunodal, ring-like loops and other convolutions at randomly spaced intervals along the lengths of the individual filaments of each secondary yarn and to cause the individual filaments of each secondary yarn to intermingle with each other and with the individual filaments of each primary yarn; wetting one of the yarns prior to feeding it into the treatment zone; and withdrawing the intermingled filaments from the treatment zone and collecting the intermingled filaments in the form of a single yarn; each primary yarn being fed into the treatment zone at a first rate between 4% and 26% higher than the rate at which the intermingled filaments are withdrawn from the treatment zone and each secondary yarn being fed into the treatment zone at a rate which is at least 2.5% higher than the rate of feed of each primary yarn and up to 30% higher than the rate at which the intermingled filaments are withdrawn from the turbulent zone.

A sufficiently turbulent fluid flow is provided in the treatment zone by means of a conventional air nozzle provided for this purpose, for example: as described in United Kingdom Patent Specification No. 732,929. In passing into the nozzle, the yarns are blown about and whipped violently so that the individual filaments are first separated and then the filaments of each secondary yarn are swirled into crunodal, ring-like loops and other convolutions which interlock with the other filaments. When the resultant bulky yarn is subjected to a gradually increasing tensile load, this interlocking ensures that part of the load is borne by the filaments of each secondary yarn.

Thus, the invention results in a bulky, continuous filament yarn comprising a multiplicity of intermingled filaments in which at least 20% of the filaments are substantially straight and free from crunodal, ring-like loops and the remainder are formed at randomly spaced longitudinal intervals with crunodal, ring-like loops and other convolutions which are separated by relatively straight portions. These convoluted filaments are intermingled with each other and with the substantially straight filaments so that, when a gradually increasing tensile load is imposed on the bulky yarn, breaking of both kinds of filaments occurs substantially simultaneously.

In the production of this bulky yarn, the primary and secondary yarns may be passed through at least two separate feeding means which are operable to feed the yarns at different speeds. Feeding means, downstream of the treatment zone, may then be provided in order to collect the bulky yarn at a further, lower speed.

As a consequence of the difference in over-feeds which are applied to the constituent yarns, the individual filaments of the bulky yarn are subjected to various degrees of strain during the bulking process. As a result, two phenomena are observed; firstly, the tighter filaments of each primary yarn have a tendency to shrink and create greater bulk in the yarn and, secondly, the loops of the filaments of each secondary yarn which appear on the surface of the bulky yarn have a tendency to be pulled back into the main body of the bulky yarn, thereby reducing pluckiness of the yarn.

The foregoing unique properties can be used to advantage to obtain still further improvement in bulkiness and reduced pickiness of the bulky yarn. This is achieved by subjecting the bulky yarn to a heat relaxing process, either as a separate operation or, preferably, as a step in the method of producing the bulky yarn.

To achieve maximum shrinkage with a synthetic yarn, it is preferable to use a contact heater or, alternatively, a tube heater which heats the yarn by a combination of both convection and conduction.

The bulky yarn formed from the intermingled filaments is fed on to or through the heater in a relaxed condition to achieve a shrinkage which is equivalent or somewhat in excess of the potential boiling water shrinkage for most synthetic yarns; this shrinkage is approximately 10%.

The yarn is therefore overfed into the heater to achieve a tension low enough to ensure that full shrinkage can take place. Many forms of heater are available, but the preferred type comprises a multipath contact heater of approximately one meter in length which is totally enclosed to increase its efficiency. The yarn is fed upwards to the top of the heater, around a roller and back through the heater, around a further roller disposed below the heater and then upwards through the heater once again. After several passes around the upper and lower rollers, the yarn is fed up to a take-up package. It is also possible to improve bulking and loop retraction in separate operations subsequent to the preparation of the bulky yarn. With knitwear, this can be done by subjecting garments to high pressure steaming at 130° C.

The heat shrinkage obtained gives improved stability during finishing and, since potential shrinkage has been decreased, fabric formed from the bulky yarn will not have the same tendency to crease during finishing of the fabric. The development of longitudinal creases in fabric is a well-known phenomenon and could cause considerable trouble during normal fabric finishing. The further reduction in pickiness of the yarn also reduces the yarn to yarn friction within the fabric and this will improve the recovery from extension and will reduce the amount of creasing developed in the fabric during normal use.

The intermingled filaments withdrawn from the treatment zone, where they are subjected to turbulent fluid flow, are eventually collected on a wind-up device, for example: a down-twister or cheesewinder and, in order to ensure that the bulky yarn is wound at an appropriate tension, it may be passed through a pair of take-up rolls which, together with the wind-up device, ensure that the bulky yarn is fed to the wind-up device with a suitable under-feed, typically between 5% and 10%.

The method according to the invention is particularly suitable for the production of bulky yarns from continuous filament yarns of polyester and polyamide. However, other continuous filament yarns can also be used, for example: polyolefin yarns, viscose yarns and cellulose acetate yarns. Variations in texture and bulk may be obtained by using constituent yarns of different materials, by using constituent yarns of different structures and by varying the relative rate of overfeed of the different constituent yarns through the treatment zone.

It has been found that by using different overfeeds for different constituent yarns passed through the treatment zone and limiting the overfeeds to 30%, bulky yarns may be produced at a much higher speed than if all the constituent yarns were fed through the treatment zone at the same speed. This therefore gives rise to greater economies in production and creates yarns which can be produced at speeds more economically than hitherto known.

The relative overfeeds of the constituent yarns will depend on the denier of the final yarn, the denier of the constituent yarns and also on the filament denier of the constituent yarns and should be maintained within 1%. It has been found by experiment, that the relative overfeeds are extremely critical and a change in filament denier or any other characteristic of the constituent yarns requires a modification of the relative overfeeds to produce a yarn which has acceptable bulk and is reasonably free from pluckiness when made into a woven or knitted fabric.

The interlocking of the filaments of the bulky yarn provides greater stability than has hitherto been attainable. This not only improves the pilling properties of fabrics made from the yarn, but improves the efficiency of subsequent processing, particularly where the yarn is used as warp in a woven fabric. The resistance is abrasion brought about by the improved interlocking of the filaments also enables the yarns to be woven without size.

Two bulky yarns, and their methods of manufacture according to the invention, are hereinafter described by way of example, with reference to the accompanying drawings, in which:

DESCRIPTION OF PREFERRED EMBODIMENTS

Figure 1:
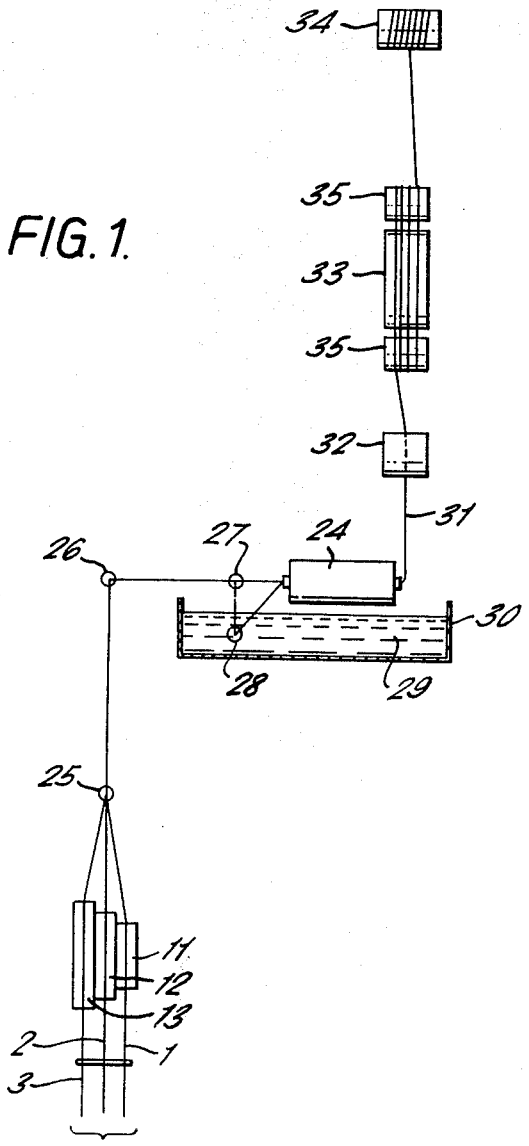
FIGS. 1 and 2 are schematic side and front elevations of apparatus for performing a method of producing a bulky yarn, according to the invention.
Figure 2:
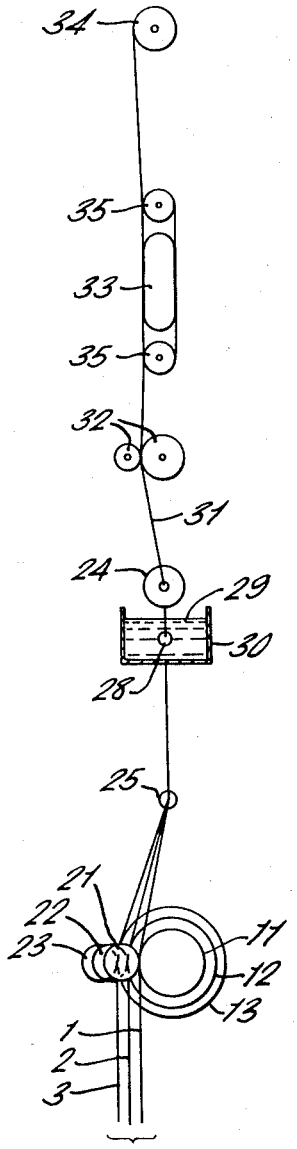

As shown in FIGS. 1 and 2, a 167 decitex 72 filament primary yarn 1 of polyester and two secondary yarns 2 and 3 comprising, respectively, a 78 decitex 20 filament yarn of polyhexamethylene adipamide (sold under the trade name Nylon) and a 167 decitex 72 filament polyester yarn are fed over axially spaced portions 11, 12 and 13 of a stepped feed roll and held in driving engagement with the feed roll by three pressure rollers 21, 22 and 23 (FIG. 2). The rotational speed of the feed roll and the diameters of the portions 11, 12 and 13 of the feed roll are such that the primary yarn 1 and the two secondary yarns 2 and 3 are withdrawn from a creel (not shown) at rates of 336, 345 and 363 meters per minute. The three yarns 1, 2 and 3 withdrawn from the creel are fed to an air nozzle device 24 through yarn guides 25, 26 and 27. However, the 167 decitex 72 filament secondary yarn 3 is pre-treated before entering into the nozzle device 24 by being passed through a yarn guide 28 immersed in water 29 in a pan 30 and is fed into the treatment zone along a path which is inclined to the path of the yarn through the treatment chamber, whereas the other two yarns 1 and 2 are fed into the treatment chamber along a path which is colinearly aligned with the rectilinear path of the yarn through the treatment zone. Inside the air nozzle device 24, the yarns 1, 2 and 3 pass through a treatment chamber (not shown) enclosing a zone of turbulent air flow which causes the filaments of the different yarns to intermingle so as to form a single composite yarn 31 which passes between a pair of cylindrical feed rolls 32 having a rotary speed sufficient to withdraw the composite yarn 31 from the nozzle device 24 at a rate of 300 meters per minute. The yarns 1, 2 and 3 are thus fed into the treatment chamber within the nozzle device 24 at rates of 36, 45 and 63 meters per minute higher than the 300 meters per minute the composite yarn 31 is withdrawn. As a result of these overfeeds of 12%, 15% and 21%, there is considerable slack in the filaments of the three yarns as they pass through the treatment chamber. The filaments of the primary yarn are therefore separated from each other and the filaments of the secondary yarns are blown about and whipped violently in such manner that the individual filaments are first separated and then swirled into crunodal, ring-like loops and other convolutions which interlock the filaments of the two secondary yarns and also interlock these filaments with the filaments of the primary yarn which are separated by the turbulence, but not themselves formed with convolutions.

After formation of the composite, bulky yarn 31, it is fed over a contact heater 33 to a take-up mandrel 34 to effect relaxation of stress induced in the filaments by the turbulence within the treatment chamber. As shown in FIGS. 1 and 2, the yarn 31 is trained around rollers 35 and is passed several times around the contact heater 33, which is heated to a temperature of about 220° C, where it is heated by convection and conduction. To accommodate a 10% shrinkage of the yarn 31 during the heat relaxation operation, the yarn 31 is passed over the contact heater 33 with a 15% overfeed so that, although the yarn 31 is fed to the contact heater 33 at a rate of 300 meters per minute, it is withdrawn at a rate of 255 meters per minute.

The yarn 31 is then passed from the contact heater 33 to the take-up mandrel 34 with sufficient underfeed to remove the slack in the yarn 31. Thus, with an underfeed of 5.9%, the yarn 31 withdrawn from the contact heater 33 at a rate of 255 meters per minute is wound onto the take-up mandrel 34 at a rate of 270 meters per minute so as to allow for the 10% shrinkage of the yarn 31 fed over the contact heater 33.

Figure 3:
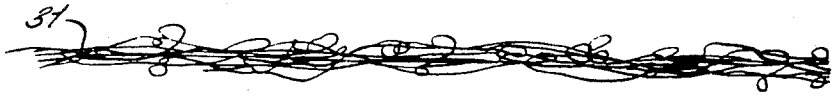
FIG. 3 is an enlarged elevational view of the bulky yarn provided by the method described with reference to FIGS. 1 and 2.

The bulky yarn 31 produced by this method has the appearance illustrated in FIG. 3.

Figure 4:
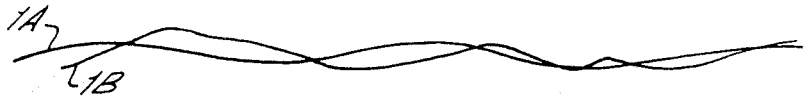
FIGS. 4 to 6 are schematic elevational views of two filaments from each of three multifilament components of the bulky yarns shown in FIG. 3.
Figure 5:
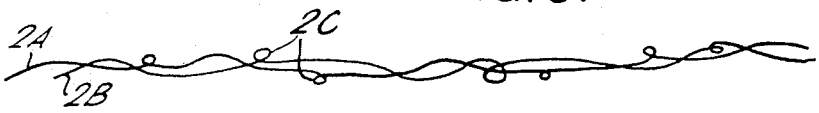
Figure 6:
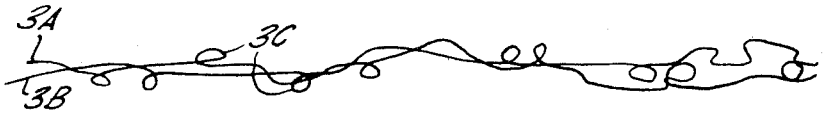

As shown in FIG. 4, filaments 1A and 1B representing two of the 72 filaments of the primary yarn are separated from each other so as to permit the insertion of convolutions formed in the filaments of the two secondary yarns, but are not themselves formed with crunodal, ringlike loops. The filaments 2A and 2B shown in FIG. 5 and the filaments 3A and 3B shown in FIG. 6 represent, respectively, two of the 20 filaments and two of the 72 filaments of the two secondary yarns and show the formation of randomly spaced crunodal, ring-like loops 2C and 3C along the lengths of the filaments, the loops 2C formed in the filaments 2A and 2B being separated by longer lengths of substantially straight filament than the loops 3C formed in the filaments 3A and 3B. After formation of the loops shown in FIGS. 5 and 6, these loops interlock the filaments of the two secondary yarns with each other and with the filaments of the primary yarn. Thus, when a gradually increased tensile load is applied to the yarn 31 the loops are prevented from collapsing and so the load is borne by all of the filaments and, on further increase in tensile loading, all of the filaments break substantially simultaneously. The primary yarn 1 provides 72 of the 164 filaments of the bulky yarn 31, that is to say: approximately 44% of the filaments of the bulky yarn.

In a second example of the method of forming bulky yarn, according to the present invention, a 150 denier 48 filament primary yarn of polyester and three secondary yarns respectively comprising two 100 denier 34 filament polyamide yarns and a further 150 denier 48 filament polyester yarn are passed through a zone of turbulence by means of three separate pairs of feed rolls and a single pair of withdrawal rolls so that the primary yarn is given an 8% overfeed, two secondary yarns of polyamide are given an overfeed of 18% and the secondary yarn of polyester is given an overfeed of 24%. Thus, for a withdrawal rate of 300 meters per minute, the primary yarn is fed into the treatment chamber at a first rate of 324 meters per minute and the secondary yarns are fed at rates of 354, 354 and 372 meters per minute. The composite yarn resulting from this combination has 164 filaments which are so intermingled as to provide a bulky texture. The 48 filaments (more than 29% of the total) of the primary yarn are relatively free of crunodal, ring-like loops, but the remaining filaments are formed with crunodal, ring-like loops and other convolutions and are interlocked with each other and with the 48 filaments of the primary yarn.

Having described my invention, I claim:

1. A method of producing bulky, continuous filament yarn in which primary continuous multi-filament yarns of polymeric material comprising at least 20% of the total filaments are substantially straight and free from crunodal ring-like loops and secondary continuous multi-filament yarns of polymeric material comprising up to 80% of the total filaments are formed at randomly spaced longitudinal intervals with crunodal ring-like loops separated by relatively straight portions and are intermingled with each other and with the substantially straight filaments of the primary yarns so that, when a gradually increasing tensile load is imposed on the bulky yarn, the filaments of both the primary and secondary yarns break simultaneously; the method including the steps of:

pre-treating at least one of the primary and secondary continuous multi-filament yarns by the application of water;

feeding the primary and secondary yarns into a treatment zone so that at least one of the primary and secondary yarns is fed into the treatment zone along a path which is colinearly aligned with a rectilinear path along which the yarn passes through the treatment zone and so that each yarn to which water has been applied enters the treatment zone while still wet;

providing within the treatment zone a fluid flow of sufficient turbulence to separate the individual filaments of the yarns, to form crunodal ring-like loops and other convolutions at randomly spaced intervals along the lengths of the individual filaments of each secondary yarn, and to cause the individual filaments of each secondary yarn to intermingle with each other and with the individual filaments of each primary yarn to form a single bulky yarn;

withdrawing the intermingled filaments from the treatment zone at a rate such that each primary yarn is fed into the treatment zone at a rate between 4% and 26% higher than the rate at which the intermingled filaments are withdrawn from the treatment zone and each secondary yarn is fed in to the treatment zone at a rate which is at least 2.5% higher than the rate of feed of each primary yarn and up to 30% higher than the rate at which the intermingled filaments are withdrawn from the treatment zone.

2. A method according to claim 1, in which the primary and secondary yarns are passed through at least two separate feeding means which feed the yarns at different speeds.

3. A method according to claim 1, in which the intermingled filaments withdrawn from the treatment zone are fed to heating means for relaxing stresses in the filaments, prior to the collection of the intermingled filaments in the form of a single yarn.

4. A method according to claim 3, in which the intermingled filaments are withdrawn from the heating means at a rate of up to 15% less than the rate at which the intermingled filaments are fed into the heating means so as to allow for shrinkage simultaneously with the relaxation of stresses in the filaments.

5. A method according to claim 1, in which the primary yarn is a 167 decitex 72 filament polyester yarn which is fed into the treatment zone at a first rate of 336 meters per minute and the secondary yarns comprise, respectively, one 78 decitex 20 filament yarn of hexamethylene adipamide and one 167 decitex 72 filament polyester yarn which are fed at rates of 345 and 363 meters per minute through the treatment zone and the composite yarn formed from the intermingled filaments of these yarns is withdrawn from the treatment zone at a rate of 300 meters per minute.

6. A method according to claim 1, in which the primary yarn is a 150 denier 48 filaments polyester yarn and the secondary yarns comprise two 100 denier 34 filament polyamide yarns and a 150 denier 48 filament polyester yarn, the primary yarn is fed through the treatment chamber at a first rate of 324 meters per minute, the two secondary yarns of polyamide are fed through the treatment chamber at a rate of 354 meters per minute, the remaining, polyester secondary yarn is fed through the treatment chamber at a rate of 372 meters per minute and the intermingled filaments of these yarns are withdrawn from the treatment zone at a rate of 300 meters per minute.

7. A method according to claim 1, wherein the one yarn which is pre-treated with water is deflected to pass through a water treatment device to cause wetting of said one yarn just prior to same passing into the treatment zone, and wherein the other yarn is moved along said path which is colinearly aligned with the rectilinear path along which the yarn passes through the treatment zone.

* * * * *